United States Patent [19]

Schmid

[11] 4,211,517

[45] Jul. 8, 1980

[54] DETERGENT SUPPLY CONTROL FOR AUTOMATIC DISHWASHER

[75] Inventor: Rolyn A. Schmid, Hayward, Wis.

[73] Assignee: Bender Machine Works, Inc., Hayward, Wis.

[21] Appl. No.: 963,795

[22] Filed: Nov. 27, 1978

[51] Int. Cl.[2] ..... F04B 49/06; F16R 31/42; B08B 3/00

[52] U.S. Cl. ..... 417/12; 137/93; 137/392; 134/57 R; 134/103

[58] Field of Search ..... 137/93, 392; 417/12; 134/57 R, 103; 340/620

[56] References Cited

U.S. PATENT DOCUMENTS

| | | | |
|---|---|---|---|
| 3,292,650 | 12/1966 | Bird et al. | 137/392 |
| 3,339,578 | 9/1967 | Smith | 137/392 |
| 3,802,447 | 4/1974 | Bender | 134/57 R |
| 4,159,632 | 7/1979 | Grantham | 68/158 |

*Primary Examiner*—William L. Freeh
*Attorney, Agent, or Firm*—James E. Nilles

[57] ABSTRACT

A commercial-type automatic dishwasher includes a motor-driven circulating pump for recirculating a washing solution, a motor-driven detergent supply pump for adding detergent to the washing solution, and a control system, including control means for operating the circulating pump for a wash cycle of predetermined length, and detergent supply pump control means responsive to the pH level of the washing solution for operating the detergent supply pump as required during the wash cycle to maintain a desired water/detergent ratio. The detergent supply pump control means also includes an adjustable automatic timer which is set for a time interval less than the time of the wash cycle (but long enough to ensure that sufficient detergent can normally be supplied for the length of the wash cycle) which operates in response to a low pH level still existing at the end of the said time interval (indicative of loss of detergent supply) to turn off the detergent supply pump and actuate a warning device which alerts the machine operator to the faulty condition.

11 Claims, 1 Drawing Figure

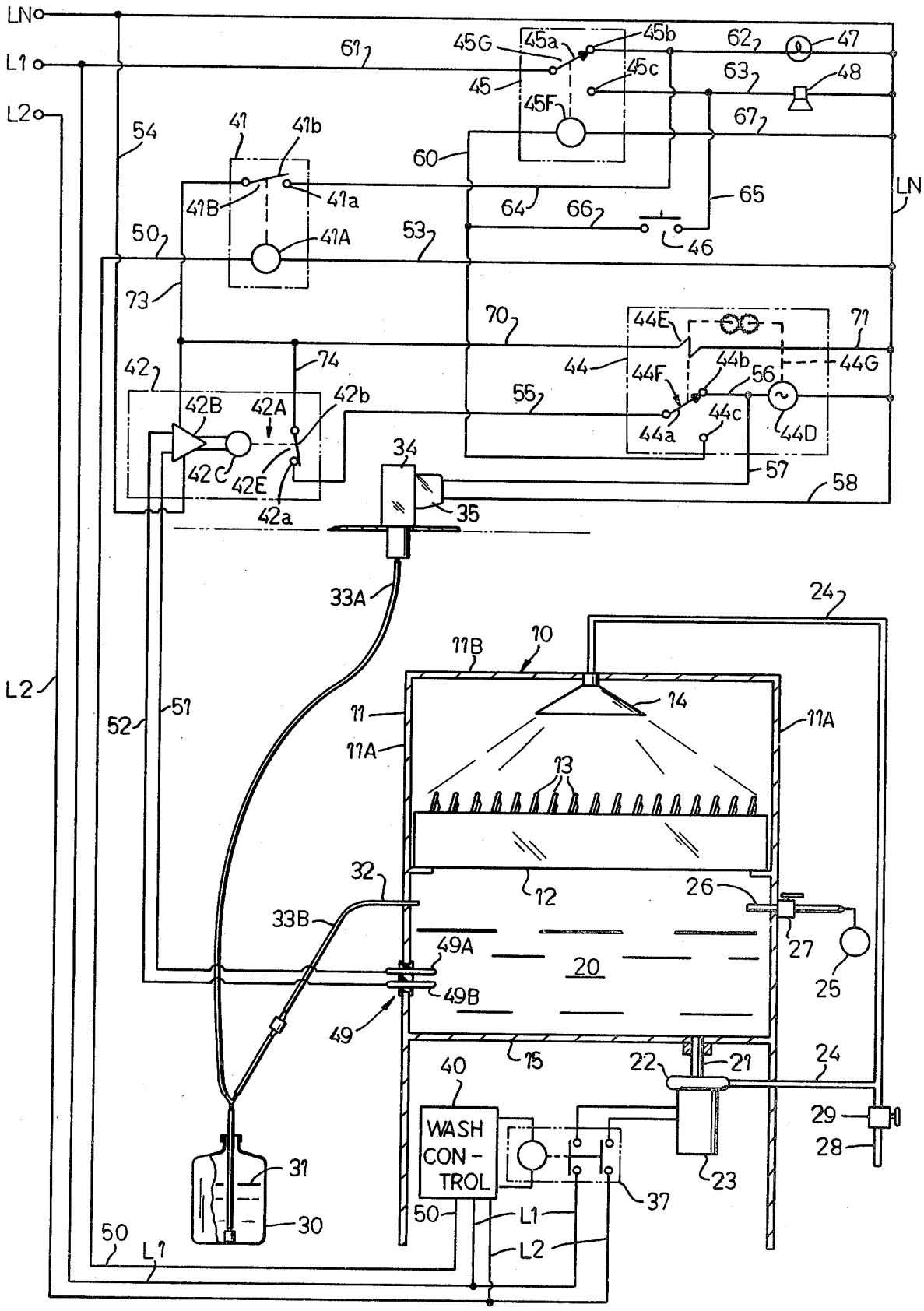
LN
L1
L2
WASH CON- TROL

DETERGENT SUPPLY CONTROL FOR AUTOMATIC DISHWASHER

FIELD OF INVENTION

This invention relates generally to automatic dishwasher machines or the like, having detergent supply pumps and, in particular, to control systems therefor.

BACKGROUND OF PRIOR ART

U.S. Pat. No. 4,015,618, owned by the same assignee as the present application, discloses prior art apparatus for automatically mixing and circulating a washing solution through dairy equipment. That apparatus comprises detergent supply pumps for adding detergents to water to form the washing solution which is then circulated by a circulating pump through the equipment. That apparatus comprises a control system, including a timer, to periodically operate the detergent supply pumps and the circulating pump in a predetermined sequence. That control system further includes an electrical probe for sensing the pH level of the washing solution to ascertain the amount of detergent being added and for controlling operation of the detergent pumps accordingly. The prior art apparatus presumes that the detergent supply will be properly maintained so there is no failure of supply during a wash cycle. However, it is not always possible to ensure adequate supply or to anticipate system malfunctions that might affect availability of the detergent supply. Thus, if the detergent supply fails for any reason and goes undetected, that particular wash cycle is carried out with insufficient detergent in the washing solution, resulting in improper cleaning of the equipment. Furthermore, there is a risk that successive wash cycles using an inadequate washing solution will be carried out undetected.

SUMMARY OF THE PRESENT INVENTION

A commercial-type automatic dishwasher includes a motor-driven circulating pump for recirculating a washing solution comprising water and detergent, a motor-driven detergent supply pump for adding detergent to the washing solution, and a control system, including wash control means for operating the circulating pump during a wash cycle for predetermined length. The control system also includes detergent supply pump control means responsive to the pH level of the washing solution for operating the detergent supply pump as required during the wash cycle to maintain a desired water/detergent ratio. The detergent supply pump control means also includes an adjustable automatic timer which is set for a time interval less than the time of the wash cycle (but long enough to ensure that sufficient detergent can normally be supplied for the length of the wash cycle) which operates in response to a low pH level still existing at the end of the said time interval (indicative of loss of detergent supply) to turn off the detergent supply pump and actuate a warning device which alerts the machine operator to the faulty condition.

The wash control means (hereinafter called "wash control"), which effects operation of the circulating pump for a wash cycle of predetermined length, also provides a concurrent electric signal to effect energization of the detergent supply pump control means (hereinafter called "detergent control"). The detergent control includes a normally open main relay which closes in response to the signal from the wash control. The main relay, when closed, cooperates with a normally deenergized two-state mechanical latching relay, to energize an adjustable conductivity sensor, to energize a "normal condition" signal light, and to energize (engage) a solenoid-operated timer clutch. The latching relay has a "normal" state and a "fault condition" state. The coductivity sensor includes a normally closed sensor relay which is actuated by a probe for sensing the pH level of the washing solution in the dishwasher. The sensor relay remains closed when insufficient detergent is present or when the conductivity sensor is not energized, but opens when the pH level is normal. The sensor relay is connected to an automatic reset timer. The automatic reset timer includes a two-state automatically resettable timer switch which is operated by a timer motor in cooperation with the aforesaid solenoid-operated timer clutch. The timer switch has a reset (normal) state which, when the sensor relay is closed (indicating low pH level), energizes the timer motor to cause the detergent supply pump motor and detergent pump to operate. The timer switch has another (transfer) state which it assumes when the timer motor completes its preset time interval and in which, provided the sensor relay is still closed because of a low pH level, it energizes the aforesaid mechanical latching relay to cause the detergent supply pump to shut off, to cause the "normal condition" signal light to shut off, and to cause an "abnormal condition" audible signal alarm to turn on.

In normal operation, if a proper pH level exists during a wash cycle, the sensor relay is energized and open and the timer motor and detergent pump motor both remain deenergized. If a low pH level occurs, the sensor relay is deenergized and closes and the timer motor and detergent pump motor are energized to operate the detergent supply pump until the proper pH level is restored, whereupon the sensor relay reopens to deenergize the timer motor and detergent pump motor.

However, under normal conditions, the timer switch has not assumed the transfer state when the wash cycle ends and, therefore, the latching relay does not assume its fault condition. Nevertheless, the timer motor still needs to be reset for the next time interval and this occurs when the timer clutch becomes deenergized and disengaged (whereby the timer motor resets) when the wash cycle ends, the wash control stops the circulating pump and deenergizes the main relay. Thus, the timer switch, the automatic reset timer, and the detergent supply pump motor are then ready for the next cycle of operation.

If a low pH level exists and the relay sensor is accordingly closed when the timer motor completes its predetermined time interval (which time interval is shorter than the wash cycle), the timer switch assumes its transfer state thereby turning off the timer motor and the detergent pump motor thereby stopping the detergent supply pump. At the same time, the mechanical latching relay becomes energized, changes from its normal state to its fault condition state, and latches mechanically in its fault condition state, thereby causing the "normal condition" light to turn off and the audible alarm to turn on. The latching relay in its fault condition state also deenergizes the conductivity sensor and the timer clutch solenoid. Deenergization of the timer clutch causes the timer contacts to reset to the normal state in readiness for the next wash cycle. A reset button must be manually actuated to cause the latching relay to be reset to its normal state.

Apparatus in accordance with the invention interrupts the operation of the detergent pump of the dishwasher when an inadequate pH level is indicated as not having been corrected within a normally adequate time interval during the wash cycle and warns the machine operator of this fact, thereby ensuring that a time-consuming and wasteful wash cycle will not be repeated, if an adequate detergent supply is not available. Or, in the case of an equipment malfunction, shutdown prevents continued operation of equipment which has failed thereby preventing possible further damage and alerts the machine operator of this fact.

Apparatus in accordance with the invention is relatively economical to manufacture since it employs commercially available components and is reliable in use.

Although the invention is herein disclosed as embodied in a commercial-type automatic dishwasher, it is apparent that it is applicable to other apparatus wherein a liquid solution is recirculated and wherein a substance is added to the solution which,, among other things, effects or changes the electrical conductivity level of the solution.

Other objects and advantages will hereinafter appear.

BRIEF DESCRIPTION OF THE DRAWING

The single FIGURE of the drawing is a schematic diagram of a dishwasher machine and of the electrical control system therefor in accordance with the invention.

DESCRIPTION OF A PREFERRED EMBODIMENT

Referring to the drawing, the numeral 10 designates a commercially available automatic dishwasher machine with which the present invention is advantageously employed. It is to be understood, however, that the invention could be embodied in other types of equipment in which a washing solution is recirculated, such solution containing water and a cleaning agent which is periodically added thereto and affects the pH level of the solution.

Machine 10 generally comprises an enclosed housing 11, including side walls 11A, a bottom wall 15, and a top wall 11B. Housing 11 contains and supports a removable rack 12 above the bottom wall 15 in which dishes 13 or other objects to be washed are placed. Housing 11 also contains a spray nozzle 14 which is disposed above rack 12.

The washing solution 20 used in machine 10 is a mixture of water and liquid detergent and, when not being recirculated, collects at the bottom of housing 11. During operation of machine 10, the solution 20 in the bottom of housing 11 drains through a drain pipe 21 in bottom wall 15 into a circulating pump 22, driven by an electric motor 23, by which it is pumped through a pipe 24 to and through spray nozzle 14, whereupon it again collects for recirculation after the spray passes over the dishes 13 in rack 12.

Water for the washing solution 20 is supplied from a source 25 through a water supply nozzle 26 extending through a side wall 11A of housing 11, which nozzle is controlled by a solenoid valve 27. Detergent 31 for the washing solution 20 is supplied from a supply tank 30 by a detergent supply pump 34, driven by an electric motor 35, through a detergent supply nozzle 32 extending through a side wall 11A of housing 11. Electric motor 35, detergent supply pump 34, tank 30, and conduits 33A and 33B are described in detail in U.S. Pat. No. 4,015,618 but could take some other form. Expended washing solution 20 can be drained from housing 11 through a waste pipe 28 which is connected at the lower end of pipe 24 and controlled by a solenoid valve 29.

The water supply solenoid valve 27 and the waste solenoid valve 29 are operated automatically as required in certain phases of the wash cycle by a wash control 40 hereinafter described. But, other than the fact that their operation can effect a change in the pH level of the washing solution 20 requiring the addition of detergent to the solution, their operation is not otherwise directly related to the invention as hereinafter described. Therefore, it may be assumed in the following discussion that these two solenoid valves 27 and 29 operate as required by the wash control 40 during the wash cycle.

In addition to motor-driven circulating pump 22 for recirculating the washing solution 20 and the motor-driven detergent supply pump 34 for adding detergent to the washing solution, dishwasher 10 includes a control system. The control system includes the wash control 40 for periodically operating the circulating pump 22 during a wash cycle, and the detergent control responsive to the pH level of the washing solution 20 for operating the detergent supply pump 34 as required during the wash cycle and while the circulating pump 22 is in operation to maintain a desired water/detergent ratio. The detergent control also includes an adjustable automatic timer 44 hereinafter described, which is set for a time interval less than the time of the wash cycle (but long enough to ensure that sufficient detergent can normally be supplied for the length of the wash cycle) which operates in response to a low pH level in solution 20 still existing at the end of the said time interval (indicative of loss of detergent supply) to turn off the detergent supply pump 34 and actuate a warning device 48 which alerts the machine operator to the fault condition.

The control system and pump motors 22 and 34 are energizable from an alternating current electrical power source comprising supply lines L1, L2, and LN. Wash control 40 is energized from lines L1 and L2. Circulating pump 23 is also energizable from lines L1 and L2 through a motor contactor 37 which is controlled by wash control 40. The detergent control is energizable from lines L1 and LN and also receive an energizing signal from wash control 40 through wire 50 whenever wash control 40 operates motor contactor 37 to energize detergent pump motor 23 and operates pump 22, as hereinafter explained. Wash control 40, which may take the form of that described in U.S. Pat. No. 4,015,618, effects operation of motor contactor 37 to energize motor 23 of circulating pump 22 for a wash cycle of predetermined length, i.e., on the order of anywhere between 40 seconds and 3 minutes. Wash control 40 includes means, not shown, whereby the wash cycle may be repeated at successive intervals, as desired.

The detergent control generally comprises a main relay 41, an adjustable conductivity sensor 42 connected to a probe 49, an automatic reset timer 44, a two-state latching relay 45, a reset switch 46, a "normal condition" indicator light 47, and a "fault condition" audible warning device 48.

Main relay 41 comprises a relay coil 41A and normally open relay signal pole contacts 41B, including a stationary contact **41*a* and a movable contact 41*b*. One side of relay coil 41A is connected by wire 50** to wash control 40 and the other side is connected by a wire 53 to line LN.

Adjustable conductivity sensor 42 includes a solid state amplifier 42B which is connected on one side to line LN by a wire 54 and on its other side by a wire 73 to contact 41*b* of main relay 41. Amplifier 42B is connected to the probe elements 49A and 49B of probe 49 by wires 51 and 52, respectively. The probe elements 49A and 49B are mounted on housing 11 of machine 10 and extend into the solution 20 collected therein. Sensor 42 further includes a sensor relay 42A which comprises a relay coil 42C and normally closed relay contacts 42E, including a stationary contact 42*a* and a movable contact 42*b*. Relay coil 42C is connected to the output of amplifier 42B. Sensor 42 may take the form of that disclosed in U.S. Pat. No. 4,015,618 and is adjustable to respond to pH levels of desired value.

Automatic adjustable reset timer 44 includes a timer motor 44D connectable by drive means 44G (including timer gears) through a solenoid-operated timer clutch 44E to operate a two-state timer switch 44F. Timer motor 44D is adjusted or set to operate for an interval of time which is less than the length of the time of the wash cycle during which the motor 23 of circulating pump 22 operates but long enough to ensure that an amount of detergent will be supplied sufficient to last for one wash cycle if the detergent pump 22 were to run the full length of the time cycle, provided an adequate supply of detergent was available. In practice, for example, a three minute wash cycle might require a 60 second time interval. Timer switch 44F comprises a movable contact 44*a* which is alternately connectable to stationary contacts 44*b* (original or reset state) and 44*c* (transfer state) and is shown in its original state wherein movable contact 44*a* engages contact 44*b*. Movable contact 44*a* of timer switch 44F is connected by a wire 55 to stationary contact 42*a* of sensor relay 42A. Stationary contact 44*b* of timer switch 44F is connected by a wire 56 to one side of timer motor 44D and by a wire 57 to one side of detergent pump motor 35. The other side of motor 35 is connected by a wire 58 to line LN. Contact 44*c* of timer switch 44F is connected to latch relay 45. Timer clutch solenoid 44E has one side connected by a wire 70 to movable contact 41*b* of main relay 41. Timer clutch solenoid 44E has its other side connected by a wire 71 to line LN. Main relay contact 41*b* is also connected by a wire 73 and a wire 74 to amplifier 42B and to contact 42*b* of the relay contacts 42E of sensor 42. In operation, with voltage applied to energize timer motor 44D and timer clutch 44E, the timer gears in drive means 44G will advance. When a preset interval of time elapses, the timer switch 44F changes state (i.e., movable contact 44*a* engages contact 44*c* instead of contact 44*b*) and the timer motor 44D is disconnected and stops. Pump motor 35 is also disconnected and stops. When timer clutch 44E is subsequently deenergized, timer switch 44F will reset to the original state in which it is shown (i.e., wherein movable contact 44*a* engages contact 44*b*). Automatic reset timer 44 may take the form of a commercially available unit known as a "Series 600 Automatic Reset Timer" described in Bulletin No. 1563-1, Sept. 15, 1973, of Deltrol Controls, Division of Deltrol Corp., 2745 South 19th Street, Milwaukee, Wisconsin 53215.

Latching relay 45 comprises a relay coil 45F and single pole two-state relay contacts 45G, including a movable contact 45*a* which is alternately connectable to stationary contacts 45*b* (normal or original state) and 45*c* (fault condition state). Contact 45G is shown in its original state wherein movable contact 45*a* engages contact 45*b*. In operation, when voltage is applied to latch relay coil 45F, the relay contacts 45G change state (contact 45*a* moves from contact 45*b*, as shown, and engages contact 45*c*) and mechanically latch therein. The next time voltage is applied to latch relay coil 45F, the relay contacts 45G return to their original state (as shown) and mechanically latch therein. Latching relay 45 may take the form of a commercially available unit known as a Potter-Brumfield "Model S89R Latching Relay" described in Catalog 100, Distributor Stock Relays, issued December 1977, and published by A-A Electric, a division of AEC, Inc., P.O. Box 325, Cedarburg, Wisconsin 53012. One side of relay coil 45F is connected by a wire 60 to transfer state contact 44*c* of timer switch 44F. The other side of relay coil 45F is connected by a wire 67 to line LN. Movable contact 45*a* is connected by a wire 61 to the power supply line L1.

Contact 45*b* is connected by a wire 62 to light 47 and contact 45*c* is connected by a wire 63 to warning buzzer 48. Contact 45*b* is also connected by a wire 64 to contact 41*a* of main relay 41. Contact 45*c* is also connected by a wire 65 to one side of reset switch 46. The other side of single pole normally open reset switch 46 is connected by a wire 66 and a wire 60 to relay coil 45F. Switch 46 is for reenergizing coil 45F and has no purpose in being connected to contact 44*c*. 45F is energized from contact 44*c* for a fault condition and is reset by switch 46 after the fault is corrected.

OPERATION

The dishwasher 10 and control means therefor in accordance with the invention operates as follows. Assume that housing 11 contains wash solution 20, as shown, and that the valves 27 and 29 are closed. Further assume that power supply lines L1, L2, and LN are energized, that wash control 40 is in operation (and set for a wash cycle of 3 minutes), that circulation pump motor contactor 37 is closed and has connected motor 23 for energization from lines L1 and L2, and that circulation pump 22 is in operation and is circulating the solution 20. Further assume that line 50 is energized and that coil 41A of main relay 41 is energized and that main relay contacts 41B are closed. Also assume that the contacts 45G of latch relay 45 are in the normal state shown and that "normal condition" light 47 is on.

Under normal conditions, electric current flows from supply line L1, through wire 61, through latching relay contacts 45*a* and 45*b*, through wire 64, and through closed main relay contact 41B of main relay 41. Current flows from closed main relay contact 41B through wire 73 to amplifier 42B of sensor 42. Current also flows from closed main relay contact 41B through wire 70 to the solenoid of timer clutch 44E and through wire 74 to 42*b*. If the pH level is too low then relay coil 42C of sensor 42 is deenergized and current flows through closed sensor relay contact 42E, through wire 55, through timer switch 44F (in its reset or normal state), to timer motor 44D to energize the latter and to energize detergent supply pump motor 35. Assume that the time interval of motor 44D is set for 40 seconds and that this is expected to be adequate for a sufficient detergent supply if detergent pump 34 were to run for the full 40 seconds. Under these conditions, detergent supply pump 34 operates to furnish detergent 31 from tank 30 to the solution 20 in washer machine 10. Also, timer motor 44D is in operation and has commenced its 40 second time interval. When a sufficient amount of detergent 31 is supplied to washing solution 20 to bring it to a desired pH level, this condition is sensed by probe 49 and sensor amplifier 42B operates to energize relay coil 42C of sensor relay 42A, thereby causing sensor relay contact 42E to open. When contact 42E opens, current flow to timer motor 44D and to detergent supply pump motor 35 is interrupted to stop detergent supply pump 34. When the wash cycle is complete, wash control 40 deenergizes contactor 37 and circulation pump motor 23 thereby stopping circulation pump 22. Wash control 40 also simultaneously deenergizes main relay coil 41A causing main relay contacts 41B to open. When contacts 41B open, this causes timer solenoid clutch 44E to be deenergized (open) causing timer switch 44F to reset in readiness for the next wash cycle (although it did not assume the transfer state because sufficient detergent was supplied within the 40 second time interval to last for the complete 3 minute wash cycle). Opening of contacts 41B also deenergizes sensor 42.

However, if during the 3 minute wash cycle the 40 second time interval comes to an end while the pH level is still too low, this means that the detergent supply is not available or has been interrupted for some reason and the following situation exists. Probe 49 has sensed the low pH level and sensor amplifier 42B has operated to deenergize sensor relay coil 42C and sensor relay contacts 42E are closed, thereby enabling timer motor 44D to operate often enough or long enough to reach the end of its 40 second time interval. When such occurs, the timer switch 44F changes state, i.e., from its original state to its transfer state, thereby interrupting current flow to timer motor 44D and to detergent supply pump motor 35, whereupon the detergent supply pump 34 stops running. With timer contact 44F in its transfer state, current flows therethrough, through wire 60, through latching relay coil 45F, through wire 67 to line LN, thereby energizing coil 45F and causing the latching relay contact 45G to change state from the normal state to the fault state and to remain mechanically latched in that state. This causes normal light 47 to be disconnected and alarm buzzer to be energized from wire 61, through contacts 45*a* and 45*c*, to line LN. This also causes current flow to sensor amplifier 42B, to solenoid clutch 44E and to sensor relay contact 42E to be interrupted. When solenoid clutch 44E is then deenergized, it allows timer contacts 44F to reset in readiness for the next wash cycle. However, since sensor relay contacts 42E are disconnected from line L1 (even though closed), resetting of timer contacts 44F does not cause restart of timer motor 44D and does not cause operation of detergent pump 34. When the 3 minute wash cycle is completed, wash control 40 deenergizes main relay coil 41A and the main relay contact 41B opens. It is necessary to close reset switch 46 to energize latch relay coil 45F and cause latch relay contact 45G to reset to and mechanically latch in the normal state (wherein contact 45*a* engages contact 45*b*) before the detergent control will be ready to operate during the next wash cycle.

Upon actuation of the alarm buzzer 48, the machine operator is warned that there is a failure of detergent supply caused either by a lack of detergent in tank 30 or by a system malfunction, whereupon necessary remedial action can be taken.

I claim:

1. In combination:

a motor-driven supply pump for supplying a substance to a liquid solution which changes the conductivity of said solution;

and control means for operating said supply pump and comprising a timer and a conductivity sensor, said timer being operable to enable said conductivity sensor to effect operation of said timer and said supply pump in response to a low conductivity level, said timer being further operable to prevent said conductivity sensor from effecting operation of said timer and said supply pump in response to a low conductivity level after said timer has operated for a predetermined interval of time.

2. In combination:

a motor-driven circulating pump for recirculating a liquid solution;

a motor-driven supply pump for supplying a substance to said solution which changes the electrical conductivity thereof;

first control means for operating said circulating pump for a first predetermined interval of time;

and second control means for operating said supply pump during (within) said predetermined interval of time and comprising a timer and a conductivity sensor, said timer being operable to enable said conductivity sensor to effect operation of said timer and said supply pump in response to a low conductivity level, said timer being further operable to prevent said conductivity sensor from effecting operation of said timer and said supply pump in response to a low conductivity level after said timer has operated for a second predetermined interval of time which is less than said first predetermined interval of time.

3. Apparatus including:

a motor-driven circulating pump operable for recirculating a liquid solution;

electrically operated supply means operable for adding a substance to said solution which changes the electrical conductivity level thereof;

and a control system, including control means for operating said circulating pump for a time cycle of predetermined length, and supply control means operable during said time cycle and responsive to the conductivity level of said solution for operating said supply means as required during said time cycle to supply a desired amount of said substance to said solution;

said supply control means including a warning device, a conductivity sensor and an automatic timer operable for a time interval less than the time of said cycle, but long enough to ensure that a sufficient amount of said substance can normally be supplied during said time interval to last for said time cycle, said timer operating in response to a low conductivity level existing at the end of the said time interval to deactivate said supply means and to actuate said warning device.

4. Apparatus according to claim 3, wherein said timer includes timer contacts having a normal state and a transfer state and a time clutch for returning said timer contacts to said normal state;

and wherein said supply control means further includes a latching relay latchable either in an original state or a fault condition state;

said supply control means being operable, when said latching relay is in said original state and when said timer contacts are in said normal state, to operate said timer and operate said supply means when said conductivity sensor responds to a low conductivity level, and to deenergize said timer and to interrupt operation of said supply means when said sensor responds to a desired conductivity level;

said supply control means being further operable when said timer contacts are in said transfer state at the end of said time interval of said timer, and when said latching relay is in said fault condition state, to deenergize said timer, to interrupt operation of said supply means and to actuate said warning device if said sensor is responding to a low conductivity level;

said latching relay being operable when in said fault condition state to deenergize said sensor and to deenergize said timer clutch to cause return of said timer contacts to said normal state;

said supply control means further including a reset switch for operating said latching relay to return said latching relay to said original state after a fault condition occurs.

5. Apparatus according to claim 4 wherein said supply control means further includes a normal condition signalling device which is actuated when said latching relay is in said original state and said circulating pump is in operation.

6. Apparatus including:

a motor-driven circulating pump operable for recirculating a liquid solution;

a motor-driven supply pump operable for adding a substance to said solution which changes the electrical conductivity level thereof;

and a control system, including circulating pump control means for operating said circulating pump for a time cycle of predetermined length, and supply pump control means responsive to the conductivity level of said solution for operating said supply pump as required during said time cycle to supply a desired amount of said substance to said solution;

said supply pump control means including a warning device, a conductivity sensor means, and an automatic timer operable for a time interval less than the time of said cycle, but long enough to ensure that a sufficient amount of said substance can normally be supplied during said time interval to last for said time cycle, said timer operating in response to a low conductivity level existing at the end of said time interval to deactivate said supply pump and to actuate said warning device.

7. Apparatus according to claim 6 wherein said conductivity sensor means including a sensor relay responsive to the conductivity level of said solution;

wherein said timer includes a timer motor, timer contacts having a normal state and a transfer state, and a timer clutch for returning said timer contacts to said normal state;

means responsive to operation of said circulating pump for enabling operation of said supply pump control means;

and a latching relay including contacts latchable either in an original state or a fault condition state;

said supply pump control means being operable, when said latching relay contacts are in said original state and when said timer contacts are in said normal state, to operate said timer motor and operate said supply pump when said sensor relay responds to a low conductivity level, and to deenergize said timer motor and to interrupt operation of said supply pump when said sensor relay responds to a desired conductivity level;

said supply pump control means being further operable when said timer contacts are in said transfer state at the end of said timer interval of said timer motor, and when said latching relay contacts are in said fault condition state, to effect deenergization of said timer motor, to interrupt operation of said supply pump and to actuate said warning device if said sensor relay is responding to a low conductivity level;

said latching relay contacts being operable when in said fault condition state to deenergize said sensor means and to deenergize said timer clutch to cause return of said timer contacts to said normal state;

said supply control means further including a reset switch for operating said latching relay to return said latching relay contacts to said original state after a fault condition occurs.

8. Apparatus according to claim 7 wherein said supply pump control means further includes a normal condition signalling device which is actuated when said latching relay contacts are in said original state and said circulating pump is in operation.

9. In a washing machine:

a motor-driven circulating pump for recirculating a washing solution;

a motor-driven supply pump for adding detergent to said solution which changes the electrical conductivity level thereof;

and a control system, including wash control means for operating said circulating pump for a wash cycle of predetermined length, and supply pump control means responsive to the conductivity level of said solution for operating said supply pump as required during said wash cycle to maintain a desired amount of detergent in said solution;

said supply pump control means including a warning device, a conductivity sensor, and an adjustable automatic timer operable for a time interval less than the time of said wash cycle, but long enough to ensure that a sufficient amount of detergent can normally be supplied during said time interval to last for said wash cycle, said timer operating in response to a low conductivity level existing at the end of the said time interval and indicative of a loss of detergent supply to turn off said supply pump and actuate said warning device.

10. A washing machine according to claim 9 wherein said timer includes timer contacts having a normal state and a transfer state and a timer clutch for returning said timer contacts to said normal state;

and wherein said supply pump control means further includes a latching relay latchable either in an original state or a fault condition state;

said supply pump control means being operable, when said latching relay is in said original state and when said timer contacts are in said normal state, to operate said timer and operate said supply pump when said conductivity sensor responds to a low conductivity level, and to deenergize said timer and to interrupt operation of said supply pump when said sensor responds to a desired conductivity level;

said supply pump control means being further operable when said timer contacts are in said transfer state at the end of said time interval of said timer, and when said latching relay is in said fault condition state, to deenergize said timer, to interrupt operation of said supply pump and to actuate said warning device if said sensor is responding to a low conductivity level;

said latching relay being operable when in said fault condition state to deenergize said sensor and to deenergize said timer clutch to cause return of said timer contacts to said normal state;

said supply pump control means further including a reset switch for operating said latching relay to return said latching relay to said original state after a fault condition occurs.

11. Apparatus according to claim 10 wherein said supply pump control means further includes a normal condition signalling device which is actuated when said latching relay is in said original state and said circulating pump is in operation.

* * * * *